US010362841B2

(12) United States Patent
Okada

(10) Patent No.: US 10,362,841 B2
(45) Date of Patent: Jul. 30, 2019

(54) ORNAMENT

(71) Applicant: MARIND CO., LTD., Osaka-shi, Osaka (JP)

(72) Inventor: Yasuhiro Okada, Osaka (JP)

(73) Assignee: MARIND CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 15/566,851

(22) PCT Filed: Apr. 12, 2016

(86) PCT No.: PCT/JP2016/061789
§ 371 (c)(1),
(2) Date: Oct. 16, 2017

(87) PCT Pub. No.: WO2016/167243
PCT Pub. Date: Oct. 20, 2016

(65) Prior Publication Data

US 2018/0132577 A1 May 17, 2018

(30) Foreign Application Priority Data

Apr. 16, 2015 (JP) ..... 2015-084588
Sep. 29, 2015 (JP) ..... 2015-192153

(51) Int. Cl.
*A44C 25/00* (2006.01)
*A44C 17/02* (2006.01)
*A44C 7/00* (2006.01)

(52) U.S. Cl.
CPC ..... *A44C 7/00* (2013.01); *A44C 17/0275* (2013.01); *A44C 25/00* (2013.01); *A44C 25/001* (2013.01)

(58) Field of Classification Search
CPC ..... A44C 17/0258; A44C 17/0266; A44C 25/001; A44C 25/007; A44C 17/0275
(Continued)

(56) References Cited

U.S. PATENT DOCUMENTS

2003/0110797 A1* 6/2003 Kimura ..... A44C 17/0275 63/31
2015/0075220 A1 3/2015 Dobashi

FOREIGN PATENT DOCUMENTS

JP 60-130711 U1 9/1985
JP 2005-58371 A 3/2005
(Continued)

OTHER PUBLICATIONS

International Search Report dated Jun. 21, 2016, issued in counterpart International Application No. PCT/JP2016/061789 (2 pages).

*Primary Examiner* — Jack W Lavinder
(74) *Attorney, Agent, or Firm* — Westerman, Hattori, Daniels & Adrian, LLP

(57) ABSTRACT

An ornament has extremely high ornamental presentability, and can easily swing and move about freely in any direction in a manner that can be sustained for a long time, as a result of which visual perceptibility is increased to observers through repetitive variation in the direction of refraction and reflection at the jewelry member. The ornament has an ornament body provided with a receiving portion; a pivot shaft provided in erect fashion on, and in such manner that a bottom end portion thereof makes contact with, said receiving portion; a rigid suspending arm portion that protrudes from a top end portion of said pivot shaft; and a jewelry member supported in pendent fashion by a lower portion of said suspending arm portion; the ornament being characterized in that said pivot shaft is capable of pivoting freely about the bottom end portion thereof as pivot point on said receiving portion.

18 Claims, 8 Drawing Sheets

(58) Field of Classification Search
USPC ..... 63/13, 14.1, 20, 30, 31
See application file for complete search history.

(56) References Cited

FOREIGN PATENT DOCUMENTS

| | | | |
|---|---|---|---|
| JP | 2009-11535 | A | 1/2009 |
| JP | 5424435 | B1 | 2/2014 |
| JP | 2015-62491 | A | 4/2015 |
| WO | 02/065868 | A1 | 8/2002 |

* cited by examiner

ORNAMENT

TECHNICAL FIELD

The present invention relates to an ornament having a jewelry member that is free to pivot.

BACKGROUND ART

Most earrings, broaches, necklaces, and other such ornaments are crafted using precious metals or other such materials that facilitate generation of luster. In addition, stratagems are employed at such ornaments to heighten visual attractiveness and decorativeness as an ornament, surfaces thereof being polished and also being imparted with complex shape or the like to constitute jewelry members and produce sensations of luster and/or brilliance in the viewer. And as one stratagem to further heighten visual attractiveness and decorativeness of a jewelry member in an ornament, the jewelry member of the ornament is such that precious metals or other such materials that facilitate generation of luster are employed in combination with gemstone(s). Known among the gemstones that may be employed here are those which, regardless of whether they are natural materials or artificial materials, have surfaces that are typically well-polished, and which are therefore capable of producing strong sensations of luster and/or brilliance in viewers and which, moreover, depending on material, may have been cut in complex fashion to constitute multifaceted surfaces, as a result of which it is not only the case that light is reflected from the surface thereof but also that light which has entered the interior thereof is refracted in complex fashion and undergoes diffuse reflection to produce the attribute of fire in complex fashion. As a result of adoption of such stratagems, by making it possible to produce in the viewer not only the superficial sensations of brilliance and/or luster but also the more profound sensation of fire and so forth, it is possible to employ these to generate the visual attractiveness and decorativeness that are desirable in ornaments.

However, the foregoing ornaments have conventionally had structures in which the jewelry member is fixed to the ornament. These have therefore been lacking in variation when viewed from the same location, the direction of the light reflected thereto from the jewelry member of the ornament tending not to change unless the angle at which light is incident on the jewelry member of the ornament changes, or the person wearing the ornament moves, or the person viewing the ornament alters his or her position. For this reason, in situations where such movement or variation has been lacking, while the viewer of the ornament may have been able to sense the luster and/or brilliance of the ornament, there has been inadequate ability to adequately sense the fire thereof, and it has not always been the case that the beauty thereof was able to be brought forth to the desired agree and made manifest. It has been hard to avoid situations in which visual attractiveness and decorativeness as an ornament have been impaired rather than enhanced, resulting in concern that the perceived value thereof may have been reduced.

Various proposals have therefore been made in attempts to achieve a structure in which the jewelry member of the ornament is made partially movable with the intention of causing the visual attractiveness and decorativeness of the ornament to be adequately manifested and the value thereof to be thoroughly brought forth.

For example, in the context of a personal accessory, an oscillating ornament has been proposed in which at least a link at one side of a pendent ring attached to an oscillating body having a jewelry member or a suspended loop supported by a human body by way of a plurality of legs, chains, or other such support means is made to have rectangular cross-sectional shape, and a part in linked contact with the paired mate of this rectangular portion is made to have a shape that is sharpened so as to be of convex arcuate cross-sectional shape (see Patent Reference No. 1). This oscillating personal accessory is intended to be such that by causing the load of the jewelry member to be supported by a link comprising a rectangular cross-sectional shape and a convex arcuate cross-sectional shape, any slight movement of the body, slight breeze, or the like is supposed to cause the jewelry member to pivot, as a result of which the brilliance of the jewelry member is supposed to be manifested more than was the case conventionally.

However, with the aforementioned proposed personal accessory, it is difficult to achieve precision high enough to cause the contact region shape at the link to engage in line contact, and so what is substantially surface contact occurs instead. For this reason, contact resistance has in practice been high, and it cannot be said that this has been sufficient for obtaining adequately repeatable swinging of the jewelry member. For this reason, because the visually perceptible fire has been of low frequency and has been weak, and the swinging dies down almost immediately, it still cannot be said that this has been sufficient to permit the visual attractiveness and decorativeness inherent in the jewelry member to be brought forth to the desired agree and made manifest.

Furthermore, in the context of a personal accessory, an oscillating personal accessory has been proposed in which cross-sectional shapes of respective inner circumferential portions of a coupling fixture and a coupled fixture, which are arcuate or ring-like and which are in mutual contact, are made to have peak-like shapes provided with linear ridges (see Patent Reference No. 2). With the goal of obtaining a line contact state by causing parts in linked contact to incorporate a structure having peak-like shapes provided with linear ridges, this is intended reduce contact resistance and to produce an effect whereby the swinging sensitivity of the jewelry member is heightened.

However, with this oscillating personal accessory, because the coupling and coupled fixtures both have arcuate or ring-like shapes, in the event that a force is applied thereto that would produce swinging that would exceed the angular range of a sloped surface relative to the suspended jewelry member, the part for suspending the jewelry member would itself, in that state and without swinging, slide in lateral fashion toward the front, toward the back, toward the left, or toward the right, as a result of which there are many restrictions on the direction in which the swinging may be applied, there is loss of the oscillatory energy that has been applied thereto, swinging does not occur, and so forth, and as many situations are observed in which swinging tends not occur, this has been inadequate as a personal accessory for causing swinging to occur in stable and continuous fashion. In this way, because the frequency with which swinging occurs also decreases, the fire produced by the jewelry member becomes weaker overall, and due to the fact that the time over which swinging can be sustained is short and so forth, the situation has been such that the expected visual attractiveness and decorativeness have not been adequately manifested but have instead been impaired.

Furthermore, with oscillating personal accessories having such means, while it has been possible with each to produce swinging in a particular direction, such as the front-to-back direction or the left-to-right direction, each has had its own idiosyncrasies with respect to manner of swinging. In other words, when the direction of the force applied to the jewelry member comes from a variety of directions, a number of disadvantages will reveal themselves in obvious fashion. That is, due to the fact that the structure is such that the part for suspending the jewelry member and a retainer at the ornamental body are linked through surface contact or line contact, when the angle about which rotation occurs is large, there being a tendency for friction to occur, constraints become apparent as movement of the jewelry member is restricted. This being the case, for a person visually perceiving the jewelry member of the ornament from a direction other than the front of the ornament, the fire produced by the jewelry member is difficult to notice; or if the fire can be noticed, from a direction other than the front, it will be found that it only lasts a short time before it disappears. And even where, to address this, design has been carried out with the goal of producing fire by causing light incident thereon to be refracted in all directions as by cutting when the jewelry member is a diamond, because constraints on movement are large, it being difficult to appreciate the visual attractiveness and decorativeness thereof from a wide range of directions, it remains difficult to say that this has made it possible for the inherent visual attractiveness and decorativeness with which it is endowed to have been brought forth and made manifest.

As another mechanism therefor, in the context of a personal accessory, an oscillating personal accessory has been proposed in which a jewelry member is suspended by a retaining fixture after the fashion of gymnastic rings from two points to the left and right diagonally above the center of the ornamental item, the body of the ornamental item being arranged so as to be inclined slightly diagonally upward, with the expectation that this will facilitate oscillation of the jewelry member (see, for example, Patent Reference No. 3).

However, because this oscillating personal accessory has a structure in which a jewelry member is supported as a result of being suspended from two points to the left and right diagonally thereabove, oscillation thereof is restricted to the direction of rotation about the axis formed by where it is held in place from the left and right. This being the case, the directions in which oscillation can be imparted thereto are limited, and as rotation to the left and right is difficult, being unable to engage in rotation to the left and right, swinging in that direction is small and is not sustained.

Moreover, while fire generated by a jewelry member produced as a result of minute swinging can be visually perceived when the person who is visually perceiving the jewelry member is directly facing the jewelry member, difficulty occurs in attempting to visually perceive the luster, brilliance, and fire generated by the jewelry member when the person who is visually perceiving the jewelry member does not directly face the jewelry member but is viewing it from the side or from a diagonal direction, and so its visual attractiveness and decorativeness as oscillating personal accessory have not been adequately satisfactory. For example, where the personal accessory is employed near the ear as is the case with an earring or stud earring, because the swinging member would be located to the side of the face, a person located in front of the wearer would likely find it difficult to directly face the jewelry member, and so one could not easily expect to be able to adequately catch sight of the fire.

As described above, with the ornaments having movable jewelry members that have been proposed to date, because oscillations are easily interrupted, because there is directionality to the directions in which swinging can occur, and because there is limited tendency to oscillate, the structure has not been such as to permit the luster, brilliance, and fire generated from the movable jewelry member to be visually perceived adequately and for a long time from a wide variety of directions in stable fashion, and from the standpoint of a structure permitting the desired visual attractiveness of the ornament to be manifested regardless of which direction it is viewed from, these have still not provided adequate satisfaction. Further improvement is therefore to be desired.

PRIOR ART REFERENCES

Patent References

PATENT REFERENCE NO. 1: Japanese Patent Application Publication Kokai No. 2005-58371

PATENT REFERENCE NO. 2: Japanese Patent Application Publication Kokai No. 2009-11535

PATENT REFERENCE NO. 3: Japanese Patent No. 5424435

SUMMARY OF INVENTION

Problem to be Solved by Invention

A problem to be solved by the present invention is to provide an ornament having extremely high ornamental presentability, permitting a jewelry member in the ornament to easily swing and move about freely in any direction, and having a structure permitting such swinging to occur in stable fashion and to be sustained for a long time, as a result of which visual perceptibility is increased to observers from a wide variety of directions through repetitive variation of the direction of refraction and reflection that constitute the luster, brilliance, and fire produced by the swinging jewelry member.

Means for Solving Problem

To solve the foregoing problems which are addressed by the present invention, the present inventor(s) arrived at the perfection of the structure of the present invention, which being a structure that causes a jewelry member to pivot more easily, is such that a rod-shaped or needle-like pivot shaft is made to stand on a concave or rail-shaped receiving portion provided at an ornament body, being made capable of pivoting freely by virtue of the fact that the bottom end of said pivot shaft which serves as pivot point makes contact with the receiving portion, a curved rigid suspending arm member furthermore being made to extend in downward fashion from a top end portion of said pivot shaft, and a jewelry member in addition being retained in pendent fashion by a lower portion of the suspending arm member. At the bottom end of the pivot shaft, a pivot point is disposed at the pivot shaft bottom end portion which comes in contact with the receiving portion of the ornament body; and because, with the pivot point at the bottom end of this pivot shaft serving as point of contact, the entirety of the pivot shaft swings front-and-back and left-and-right and engages in tilting motion, the jewelry member which hangs down from the top end of the pivot shaft also swings and moves about.

A first means in accordance with the present invention for solving the foregoing problems is therefore an ornament that has an ornament body which is provided with a receiving portion; a pivot shaft provided in erect fashion on, and in such manner that a bottom end portion thereof makes contact with, said receiving portion; a rigid suspending arm portion that protrudes from a top end portion of said pivot shaft; and a jewelry member supported in pendent fashion by a lower portion of said suspending arm portion; the ornament being characterized in that said pivot shaft is capable of pivoting freely about the bottom end portion thereof as pivot point on said receiving portion.

Now, if the position capable of causing this pivot shaft to come to rest in upright fashion is assumed to be its state when at rest, each time that a swing is applied thereto and the pivot shaft swings and moves about the bottom end thereof as pivot point, the jewelry member which hangs from the suspending arm portion at the top end of this pivot shaft will swing and move about in a direction opposite the direction of tilting of the top end of the pivot shaft. That is, when the pivot shaft tilts to the right, the jewelry member will move to the left and will also assume a position which is somewhat higher than its rest state That is, the center of gravity of the member(s) which rest on the receiving portion—in other words "the center of gravity of the pivot shaft, the suspending arm portion, and the jewelry member"—will, when the pivot shaft tilts, move slightly diagonally upward as compared with its rest state. The rest state being the most stable state and the state in which the center of gravity is lowest, when the pivot shaft engages in tilting motion front-and-back and left-and-right, potential energy increases to the extent that the center of gravity moves diagonally upward. Because the suspended jewelry member is near the center of gravity and tilts in counterweight fashion in the direction opposite the tilting of the pivot shaft, the torque about the pivot shaft bottom end which serves as pivot point causes it to move in such fashion as to swing back in the direction from which it came. From this point, the tilted pivot shaft does not proceed to fall down but moves so as to be directed toward its rest state, momentum however causing it to then tilt in the opposite direction, after which it then attempts to return to where it was, pivoting occurring in repeated fashion in this way. In addition, when one looks only at the location of the center of gravity, the center of gravity will be seen to move as if it were a pendulum suspended from the pivot point of the pivot shaft.

In addition, because the collective center of gravity of the pivoting components (pivot shaft, suspending arm portion, and jewelry member) is lower than the pivot point at the pivot shaft bottom end which contacts the receiving portion, when the pivot shaft is tilted by on the order of what is a small angle relative to the rest state, because it will repeatedly engage in motion whereby a more stable rest state is sought in iterative fashion, it will continue to pivot repeatedly in stable fashion for a long time until its momentum is attenuated.

In accordance with the present invention, because the jewelry member of the ornament swings and moves about for a long time, it does not tend to come to rest, and because it can be made to continue to pivot in a wide variety of directions, the luster, brilliance, and fire generated from the jewelry member can be visually perceived adequately and for a long time by observers in many directions, permitting it to manifest a decorativeness and a visual attractiveness that are quite excellent. In addition, at an ornament having this novel structure, as the bottom end of a rod-shaped or needle-like pivot shaft is made to stand on a receiving portion of the ornament body, and is made to come in contact therewith in such fashion as to form a pivot point, a jewelry member is made to hang down by way of a suspending arm portion that extends from the top end of this pivot shaft, as a result of which the structure is made capable of causing repeated pivoting of the pivot shaft with the bottom end thereof serving as pivot point.

Because the jewelry member has a certain degree of weight, inasmuch as it is a cut gemstone or precious metal that has been subjected to decoration, the pivot shaft from which such jewelry member is suspended by way of the suspending arm portion is such that the bottom end thereof is somewhat pressed against the receiving portion. By virtue of the fact that this is suitably pressed against the receiving portion, it swings and moves about in stable fashion; and because it hangs below the receiving portion, the center of gravity thereof is low, pivoting action tending to occur in stable fashion to the extent that this is the case. Furthermore, the suspending arm portion which retains the jewelry member in pendent fashion is a member for causing the jewelry member to hang down from the top end portion of the pivot shaft, and as it protrudes from the top end portion of this pivot shaft, it is a member that might, for example, be a rigid body of precious metal and be formed in integral fashion with the pivot shaft. The pivot shaft is such that the bottom end thereof is made to come in contact with the receiving portion, the upright state thereof being maintained as it swings and moves about the bottom end as pivot point. That is, taking the end which forms the pivot point as the bottom end, the top end portion swings widely as the pivot shaft swings and moves about; but despite this, however, because it does not immediately fall down to one side but tilts back in the direction which is opposite the direction in which it had been leaning, it remains upright as it swings and moves about while all the time making contact with the receiving portion.

A second means in accordance with the present invention for solving the foregoing problems is the ornament according to the first means characterized in that the suspending arm portion is an arcuate or ring-like rigid body; and the jewelry member supported in pendent fashion by the lower portion of said suspending arm portion hangs below the receiving portion.

That is, the suspending arm portion might, for example, be provided with an arm that is ring-like or an arm that is curved in arcuate fashion, which provides support from either one side or from both sides, the bottom end of the arm that protrudes from the side(s) of the top end of the pivot shaft being curved so as to extend to a location below the pivot shaft, a diamond or other such gemstone or jewelry member decorated with precious metal engaging with and secured to the bottom end of that arm, such that the jewelry member is suspended from the top end of the pivot shaft by way of the arm portion. This being the case, because the bottom end of the arm portion curves down below the receiving portion that contacts the pivot shaft which is provided at a part that is worn on the body, the jewelry member which is secured to the bottom end of the arm will be disposed below the receiving portion.

Furthermore, if the top end of the pivot shaft tilts to the right, the center of gravity which is below the pivot point will, together with the jewelry member that hangs below the rigid arm, move diagonally upward and to the left. If the top end of the pivot shaft tilts to the front, the center of gravity will, below the pivot point, move diagonally upward and to the back. Because the center of gravity rises somewhat as the direction is always moving in counterweight fashion, a torque acts thereon in a direction tending to cause it to naturally return to where it was. This therefore continues to pivot, going back and forth all the while. Furthermore, because the arm is an arcuate or ring-like rigid body, widening to the side(s) in overhanging fashion, movement of the center of gravity proceeds smoothly during pivoting, the jewelry member being such that upward movement of the center of gravity causes it to, as a result of the curvature of the arm, also simultaneously move laterally, as a result of which the potential energy naturally follows the pivoting motion. Furthermore, because the arm itself also has a center of gravity, to the extent that it is overhangs to the side(s) in curved fashion, momentum thereof during pivoting is increased by a corresponding amount.

A third means in accordance with the present invention for solving the foregoing problems is the ornament according to the first or second means characterized in that the receiving portion is provided along a long direction thereof with a groove, a top face of which is open; and the long direction thereof is curved in arcuate half-moon fashion.

The cross-section of the groove may be shallow and V-shaped or U-shaped, the fact that contact of the bottom end of the pivot shaft therewith occurs within the groove making it tend not to become disengaged therefrom even when oscillation is such that there is a large amount of tilting of the pivot shaft. In addition, because the groove overall is of curved shape, the bottom end of the pivot shaft naturally finds it way to the lowest location therealong, as a result of which stable positioning thereof is made possible.

A fourth means in accordance with the present invention for solving the foregoing problems is the ornament according to the first or second means characterized in that the receiving portion is a rail having a U-shaped cross-section, a top face of which is an open end thereof; and said rail is such that it is curved in arcuate half-moon fashion in a long direction thereof.

Because the structure of the present invention is such that a bottom end of a pivot shaft is made to contact a receiving portion in such fashion that said bottom end acts as pivot point, so that a jewelry member suspended by way of a suspending arm portion from the pivot shaft top end is supported in freely pivotable fashion, it is important that the bottom end of the pivot shaft be capable of making smooth contact with the receiving portion. As the receiving portion, a rail which bows upward is therefore employed, the cross-section thereof being U-shaped, the opening of which faces up. Because the groove is U-shaped, the bottom end of the pivot shaft tends not to become dislodged from the groove, permitting a stable pivoting state to be obtained when swinging occurs in the left-to-right direction in such fashion as to straddle the rail. Moreover, because the rail overall is curved so as to be bowed upward, the pivot shaft seeks to contact the groove of the receiving portion in such fashion as to be naturally guided to the lowest location along the inside surface of the rail even when the pivoting of the pivot shaft is in the long direction of the rail. Because the rail is curved, there is less occurrence of the sort of situation whereby the pivot shaft moves in sliding fashion along the inside of the rail with each swing, and since there is less tendency for occurrence of wasteful attenuation, it is possible for it to swing and move about for a long time.

A fifth means in accordance with the present invention for solving the foregoing problems is the ornament according to the first means or the second means characterized in that the receiving portion is depressed in concave fashion at a center thereof.

In accordance with this fifth means, the top plane of the receiving portion is depressed in concave fashion, causing it to be cuplike in shape, to constitute the location at which it will make contact with the pivot shaft thereabove. In addition, if the shape of the bottom end of the pivot shaft which comes in contact therewith is made to be curved in the shape of a hemisphere of curvature tighter than the curvature of the depression, this will make it possible for the point of contact between the receiving portion and the bottom end of the pivot shaft which comes in contact with the concave depression at the receiving portion to move within the concave receiving portion in correspondence to the tilting of the pivot shaft. By thus causing the concave curvature and the bottom end of the pivot shaft to be curved where they make mutual contact, it will be possible for tilting of the pivot shaft to proceed smoothly.

For example, were a cylindrical rod-shaped pivot shaft come in contact with a planar saucer thereunder, upon returning to the rest position, the circle of the planar base of the pivot shaft and the plane of the receiving portion would come into flush contact with each other such that there is surface contact therebetween. Because movement would be in danger of stopping briefly with the clash that occurred each time surface contact was made, pivoting motion would tend not repeat, and swinging would tend to subside quickly On the other hand, where, as with the means of the present invention, the bottom end of the pivot shaft is curved in the shape of a hemisphere in parallel fashion with the curvature of the depression that is curved in concave fashion, and is made to come in contact with the concavely curved surface, because even when at the rest position it will only be one point at the hemispherical bottom end that comes in contact with one point at the concavity of the saucer, swinging will not quickly subside, but rather this will swing and move about in repeated fashion for a while. Because the pivot shaft has some small amount of thickness, the location at which point contact of the curvature of this bottom end occurs moves in correspondence to the tilting. This being the case, the swinging will tend to stop less easily, and it will be able to remain engaged in the concavity, without becoming dislodged therefrom, stably being borne thereby, notwithstanding that it is in a more tilted state, due to movement of the pivot point. Moreover, increasing the depth of the concave depression will make it tend to not so easily become disengaged even when it is made to bounce in upward fashion thereabove or the like, and because the pivot point is made capable of moving during tilting, this will facilitate contact of the pivot shaft so that it does not become disengaged therefrom despite being tilted at a large angle. Therefore, even when a fairly large swing is applied thereto, the pivot shaft will tend not to become disengaged from the portion that is worn on the body, permitting this to be ornament in which swinging occurs in stable fashion.

A sixth means in accordance with the present invention for solving the foregoing problems is the ornament according to any of the first means through the fifth means characterized in that the bottom end of the pivot shaft is curved in hemispheric fashion. As contact is made such that the bottom of the pivot shaft serves as pivot point, if the pivot shaft which is made to engage in reciprocating motion over and over were columnar with a base such as that of a cylinder, because that base would engage in surface contact when in the rest state but would thereafter transition to point contact, the pivoting motion would tend to stop. Because the bottom end is therefore made to be curved in hemispheric fashion such that point contact occurs, pivoting motion will tend not to stop but will proceed smoothly and will tend to be sustained.

A seventh means in accordance with the present invention for solving the foregoing problems is the ornament according to any of the first means through the fifth means characterized in that the bottom end of the pivot shaft is in a shape of a conically pointed needle. The bottom end of the pivot shaft is made sharp such that it is in the shape of a cone, permitting it to enter the depression of the receiving portion and be supported thereby. Because the locus of the point of contact is point contact as made by the tip of a needle-like shape, and because, as tilting proceeds, this moves smoothly within the saucer of the receiving portion which is concave at the portion where contact occurs, the pivot point moves along the receiving portion in correspondence to the tilting. Existence of the depression makes it tend to not so easily become disengaged even when it is made to bounce up due to oscillation in the vertical direction, and the pivot shaft does not become disengaged but is made able to continue to make contact with the receiving portion despite being tilted at a large angle. Furthermore, because the tip of the needle that makes point contact is able to move smoothly in all directions as it engages in tilting, it is able to engage in swinging for a long time as it undergoes small oscillations, regardless of the direction in which oscillations are applied thereto.

Benefit of Invention

Because the jewelry member of the ornament in accordance with the present invention is such that the jewelry member is suspended from the top end of the pivot shaft by way of the suspending arm portion, the pivot shaft being such that it is only the bottom end thereof that comes in contact with and stands on the receiving portion, it swings extremely easily, permitting it to respond in sensitive fashion to even the tiniest of peripheral oscillations. In particular, because the pivot shaft bottom end which serves as pivot point makes contact with the receiving portion in point contact fashion, it is capable of pivoting in a wide variety of directions.

Furthermore, because the center of gravity of the suspended jewelry member and the suspending arm portion and the pivot shaft is disposed at a location which is lower than the pivot point at the bottom end of the pivot shaft when at rest, permitting stable production of torque, although the pivot shaft may tilt it does not fall down, permitting action whereby it is able to swing back in the direction from which it came. That is, inasmuch as the jewelry member suspended therefrom has three-dimensional weight, the center of gravity will move diagonally upward in the direction opposite the direction in which the pivot shaft tilts, causing the center of gravity to become offset from a vertical drawn through the pivot point thereabove. Because it will therefore naturally tend to return to the low position that the center of gravity had when at rest, which is on a vertical drawn so as to pass through the pivot point, pivoting is carried out repetitively in natural and stable fashion; and at the same time, because the tilting of the pivot shaft and the direction of movement of the center of gravity are in opposite directions, the shaft does not proceed to fall down in the direction in which it is tilted but instead pivots repeatedly after the fashion of simple harmonic motion. Furthermore, because it pivots repeatedly in stable fashion, it is able to keep swinging for a long time.

In addition, because the pivot shaft is such that it is only the bottom end thereof that makes contact with the receiving portion, the pivot shaft can engage in tilting motion freely in any direction front-and-back and left-and-right, and there is no significant constraint with regard to the direction in which oscillation is imparted thereto. That is, in accordance with the means of the present invention, the jewelry member does not engage in reciprocating-motion-like oscillation in a single direction but is capable of pivoting in repeated fashion, without limitation as to direction, in such fashion as to follow the tilting front-and-back and left-and-right, permitting it to swing and move about with no particular limitation with respect to the direction in which oscillation is imparted thereto.

Moreover, due to the fact that the ornament of the present invention employs a three-dimensional jewelry member, because when made to swing in a wide variety of directions the center of gravity changes so to accommodate the respective directions of that swinging, the direction in which swinging occurs can change in correspondence to the direction in which oscillation is applied thereto. In addition, whereas following application of oscillation it eventually returns to its stable initial position, because release of the accumulated potential energy causes it to pivot repeatedly after the fashion of a pendulum, it oscillates for a long time, and because the direction in which the fire is directed continues to change in minute fashion, the appeal of the cut of the jewelry member is brought forth to the maximum degree. Moreover, application of new and different oscillations produces variation in amplitude as well as direction, permitting it to continue to swing in complex fashion.

In this regard, besides the fact that swinging is facilitated, because the oscillations that are applied thereto may be in a wide variety of directions, when it is worn, because not only actions such as walking and the like, or any slight movement of the face, or of the arms or the legs, or of some other part of the body but even such small oscillations as are applied thereto as a result of an activity on the order of normal breathing are able to cause swinging to occur, it will be the case when worn that oscillations will continue to be applied thereto, and so it will keep swinging in continuous fashion. In addition, because the suspended jewelry member repeatedly swings and moves about, swinging of the direction of reflection and refraction relative to the light which shines thereon causes there to be constantly be complex and diverse variation. Here, the sparkling variation in the luster, brilliance, and fire serving as the ornamental presentability resulting from reflections produced by the jewelry member will more easily catch the eye of a peripheral observer, and because it is easily made to swing upon occurrence of any tiny swinging, the sparkly glitter can be visually perceived adequately and for a long time, and the visual attractiveness and decorativeness thereof can be adequately made manifest, permitting attainment of high ornamental presentability.

Furthermore, because the pivoting components are small and light as compared with the overall ornament, the period of their pivoting will be short, and because they will therefore swing in minute fashion, they will display a greater amount of more sparkly glittering as compared with the large and slow movement that occurs when the overall ornament swings, causing them to be more easily visually perceived.

Moreover, when, as with the second means, a suspending arm portion which is integral with the pivot shaft is made to protrude therebelow from the top end of the pivot shaft, by causing the arm to be arcuate or ring-like, and by causing the suspended jewelry member to be disposed at a location which is lower than the pivot point, because the length from the top end of the pivot shaft to the center of gravity of the pivot shaft and the suspending arm and the jewelry member when at rest will be greater than the length of the pivot shaft, it will to this extent tend to be stable. Furthermore, because the distance moved by the suspended jewelry member will be greater than the distance moved by the top end of the pivot shaft, adequate variation will be displayed in the manner of refraction and reflection at the jewelry member even for small tilt angles, permitting it to be clearly visually perceived in shiny sparking fashion for a long time. Moreover, because it is a rigid body, it does not wobble even during tilting, and so it moves smoothly, without occurrence of bending or the like relative to the jewelry member that moves in the direction opposite the tilting of the pivot shaft. Furthermore, because the arm is an arcuate or ring-like rigid body, widening to the side(s) in overhanging fashion, movement of the center of gravity proceeds smoothly during pivoting, the jewelry member being such that upward movement of the center of gravity causes it to, as a result of the curvature of the arm, also simultaneously move laterally, as a result of which the potential energy is such that the pivoting motion is more easily attained, and momentum furthermore increases by a corresponding amount when pivoting is occurring.

Furthermore, in accordance with the third means and the fourth means, the receiving portion is formed so as to be long in a long direction thereof, making it possible that the pivot shaft tends not to become dislodged from the groove, and making it possible for swinging to occur in repeated and stable fashion. Furthermore, causing the groove in the long direction to be such that a rail is curved in upwardly directed fashion reduces the tendency for the pivoting of the pivot shaft to be attenuated. That is, even where the bottom end of the pivot shaft slides along the groove of the rail due to a situation such as application of oscillation causing a large amount of tilting in the long direction, because the bottom end of the pivot shaft slides back along the inside of the curved groove and is quickly guided to the lowest position thereof, the bottom end of the pivot shaft does not repeatedly slide along the rail of the groove any number of times, and so even in the case of swinging in the long direction, it is possible to avoid a situation in which significant attenuation of swinging would quickly occur. There is therefore no particular limitation with regard to the tilting direction, and stable pivoting can be attained for a long time. In accordance with the fourth means, because in particular the cross-section is U-shaped, even when swinging occurs in such fashion as to straddle the groove, because it will be possible for the bottom end of the pivot shaft to make contact therewith in smooth fashion, it is possible for pivoting to occur in stable fashion and for a longer time.

Furthermore, in accordance with the fifth means, because the receiving portion is curved in concave fashion with a cross-section in the shape of an arcuate depression, the bottom end of the pivot shaft tends not to disengage and become dislodged from the receiving portion during tilting, and because inclination changes as it moves along the receiving portion without snagging, movement is smooth. Swinging therefore tends not to subside, and it is possible for swinging to occur in repeated fashion for a long time.

Moreover, in accordance with the sixth means, because the region at which point contact of the curvature of the bottom end of the pivot shaft occurs moves in correspondence to the tilting, it is possible for point contact to be maintained. When combined with the third means and/or the fourth means, the bottom end of the pivot shaft, because it is curved, tilts smoothly along the receiving portion which has arcuate cross-section, as a result of which attenuation tends not to occur, making it possible for pivoting to be maintained for a long time.

Furthermore, in accordance with the seventh means, because the bottom end of the pivot shaft is made sharp such that it is in the shape of a cone, this causes there to be point contact, making it possible for the pivot point to tilt smoothly along the receiving portion in correspondence to the tilting, and making it possible for swinging to continue without snagging. Furthermore, when combined with the third means and/or the fourth means, it will, due to the depression having arcuate cross-section at the receiving portion, tend not to become disengaged; and it will be possible to cause the pivot shaft to stay in contact with and not become disengaged from the receiving portion despite being tilted at a large angle. Furthermore, because the tip of the needle that makes point contact is able to move smoothly in all directions as it engages in tilting, it is able to pivot for a long time as it undergoes small oscillations, regardless of the direction in which oscillations are applied thereto.

EMBODIMENTS FOR CARRYING OUT INVENTION

Figure 1:
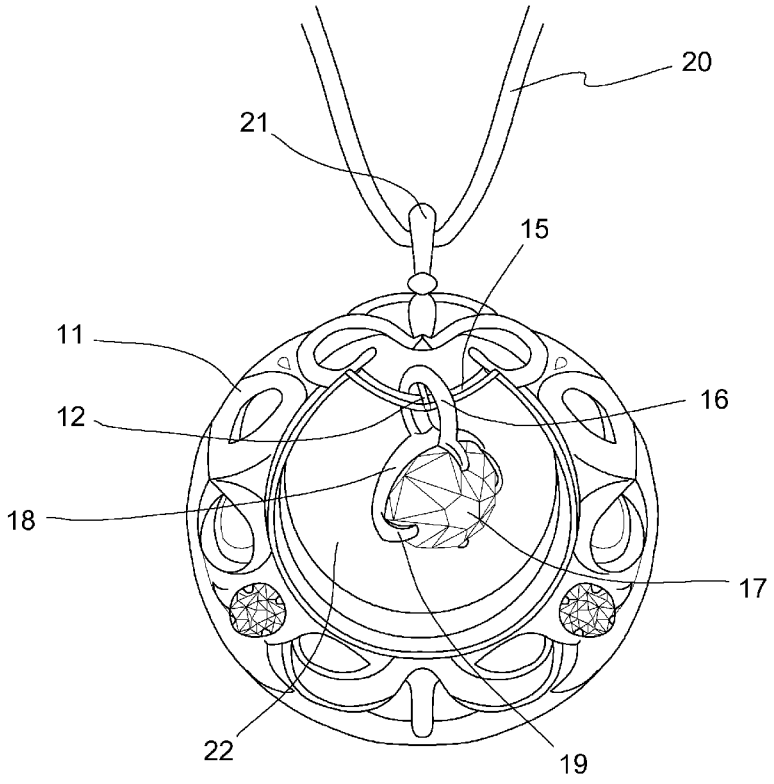
FIG. 1 Drawing illustrating overall structure of an ornament body in accordance with a first working example of the present invention.

Below, embodiments for carrying out the present invention are described with reference to the drawings where appropriate. Note that, for purposes of describing the present invention in specific terms, the following description employs the example of a pendant provided with a necklace as an ornament body (11). The present invention is of course not limited to necklaces but may also be applied to stud earrings, earrings, ear cuffs, necklaces, broaches, rings, cuffs, and necktie pins, so long as that ornament body has provided therein a receiving portion that comes in contact with the bottom end of a pivot shaft, a jewelry member being supported in pendent fashion by a suspending arm portion by way of the pivot shaft. Moreover, it may also be applied to a decorative wristwatch.

First, because the pivot shaft (12), the suspending arm portion (16) which protrudes from the top end portion (13) of the pivot shaft, the jewelry member (17) which is suspended below the suspending arm portion, and the jewelry member setting (18) for supporting the jewelry member in pendent fashion are such that the entirety pivots in integral fashion about the bottom end (14) of the pivot shaft which serves as pivot point, the term "pivoting components" is hereinafter used to collectively refer to these when describing the motion of these together as an integral unit.

Now, preferred as the pivot shaft (12) and the suspending arm portion (16) in accordance with the present invention is that these be made to have rigidity as a result of being constituted by an integral member made of precious metal(s), for example, it moreover being preferred that the setting (18) and/or other supporting parts from which the jewelry member (17) is suspended also be formed in integral fashion with respect to the bottom end of the suspending arm portion. As precious metal, while gold, silver, platinum group metals, and/or alloys employing these as primary constituent(s) are preferred, other metal(s) may be employed, and these may furthermore be made to undergo surface coating treatment with precious metal(s) through methods such as plating, vapor deposition, and/or the like. Besides these, it can also be applied to items formed in integral fashion from hard plastic resin(s), and/or items in which these have furthermore been made to undergo surface coating treatment with precious metal(s). Among these, with regard to the pivot shaft (12), the suspending arm portion (16), and the setting (18) which secures the jewelry member (17), besides the fact that it is possible to obtain these by preparing an item obtained by pouring the same material for each of these into die(s) and molding them in integral fashion, the respective parts may be joined together in integral fashion by welding and/or adhesive to produce the finished pivoting components.

Furthermore, with respect to the setting (18) for supporting the jewelry member (17) provided at the bottom end of the suspending arm portion (16), where, for example, a diamond is to be supported thereby, prong(s) (19) might be made to protrude from the setting (18) so as to permit retention of a gemstone or other such jewelry member (17), thus permitting the diamond to be appropriately supported by and secured to the setting (18). Of course, so long as it is capable of causing the jewelry member (17) to be supported by and secured to the bottom end of the suspending arm portion (16), there is no restriction with regard to the specific configuration of the setting (18) or the manner in which the jewelry member (17) is secured thereby, and so the jewelry member (17) might, for example, be removably and/or replaceably mounted in the setting (18).

It being desirable that these be such that the suspended jewelry member (17) is capable of causing reflection and refraction of light incident thereon from a light source when these are made to undergo minute swinging, well-polished decorative precious metal(s) and/or gemstone(s) as well as imitations thereof may be cited as examples. As gemstone, while diamond which is endowed with bountiful reflection and refraction is preferred, a wide range of other gemstones may also be employed, without regard to whether they are transparent or opaque, these including, for example, rock crystal, quartz, pyroxene, feldspar, emerald, ruby, sapphire, garnet, aquamarine, amethyst, cat's eye, tourmaline, apatite, opal, jade, coral, and amber. Of these, those that have undergone surface machining in which the surface has been cut in complex fashion are preferred because of the way they glitter due to reflection and refraction. Furthermore, precious metals are gold, silver, platinum group metals, as well as alloys thereof; and it is also possible to employ items that have been made to undergo surface coating treatment with such precious metal(s).

Figure 2:
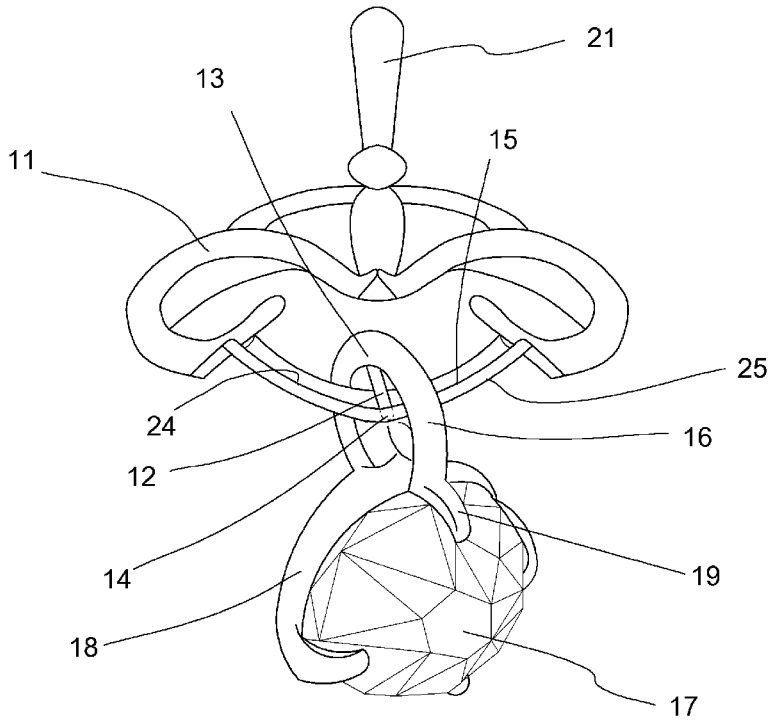
FIG. 2 Drawing illustrating pivoting components and the upper portion of the ornament body in accordance with the first working example.
Figure 3:
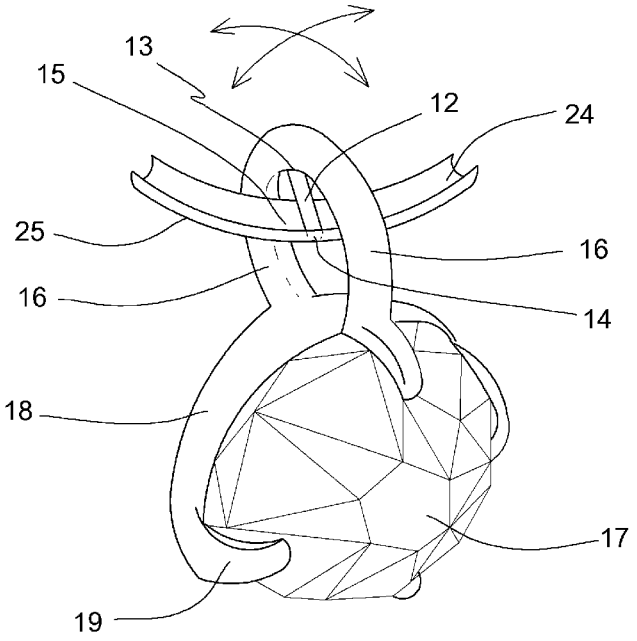
FIG. 3 Drawing illustrating pivoting components and rail portion of the ornament body in accordance with the first working example.
Figure 4:
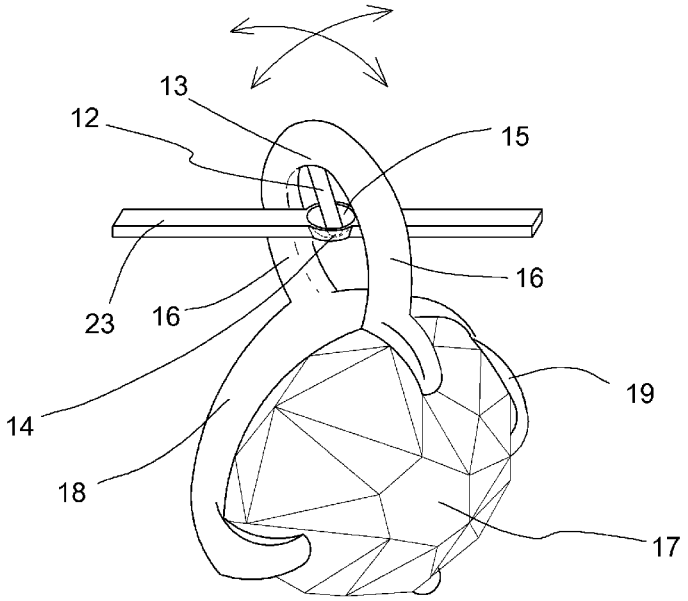
FIG. 4 Drawing illustrating an example in which a concave receiving portion is provided at the top face of a horizontal rod, contact with the bottom end of a pivot shaft providing support for pivoting components in accordance with another embodiment of the present invention.

The receiving portion (15) is a region that comes in contact at the top flat surface thereof with the pivot shaft bottom end (14), it being possible so as to permit the load of the pivot shaft (12) to be borne thereby for, for example, the ornament body (11) to be provided with a horizontal rod (23) and for a concave portion formed by causing part of the top surface of the rod body to be relieved in conical or hemispherical fashion to be employed as the receiving portion (15) as shown in FIG. 4, or for a rail-like part having a V-shaped groove provided along the long direction thereof, or a groove (24) having a U-shaped cross-section, in which the top face thereof is the open face, provided at the ornament body (11) to be employed as the receiving portion (15) as shown in FIG. 2 and FIG. 3. If the open rail (25) of the groove (24) at this receiving portion (15) is itself bowed in arcuate half-moon fashion, because the place where contact occurs at pivot shaft bottom end (14) will naturally be guided to the lowest portion of curved groove (24), even when a rail-like part is employed as receiving portion (15), the phenomenon whereby sliding in lateral fashion such as would cause a large amount of movement by pivot shaft bottom end (14) within groove (24) when the pivot shaft (12) tilts in the direction of the groove (24) of the rail (25) is reduced. Attenuation of swinging is therefore suppressed. In addition, where such a rail-like groove is used, because manufacturing operations can be made more simple than would be the case if a receiving portion were to be provided at a part of a rod body, this will facilitate manufacture. For example, if a drill or the like were to be used to form a conical concavity to serve as receiving portion (15) on a thin rod of diameter 1 mm or less, there would be a tendency for this to be inconvenient and for there to be variation in procedures due to precision and centering; but if a rail-like part having a groove (24) of U-shaped cross-section in the long direction thereof were to be made, this would not be very difficult, and even the process of bending the rail (25) so that it is somewhat bowed could be managed within particular difficulty. Moreover, this may also be fabricated with good precision through use of a vacuum casting apparatus employing a die or the like.

Figure 8:
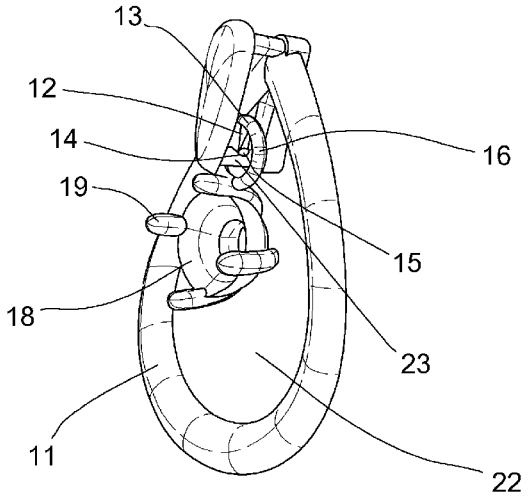
FIG. 8 Drawing illustrating overall structure of entire ornament in accordance with a second working example.
Figure 9A:
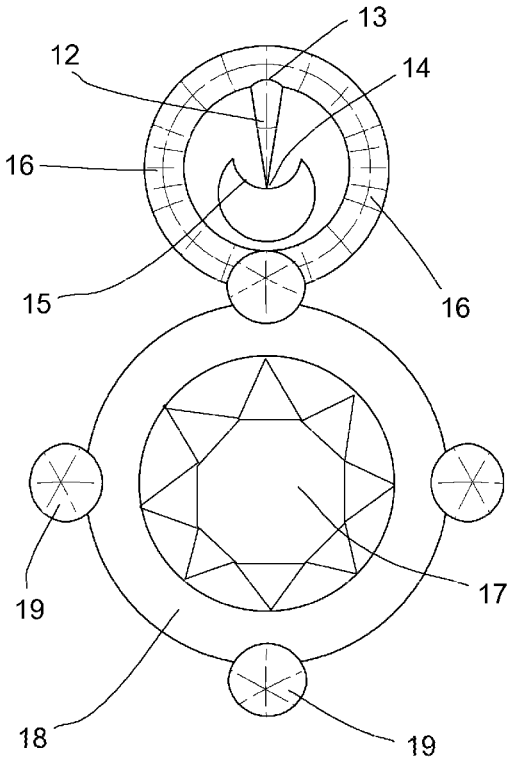
FIGS. 9A and 9B Explanatory drawings showing in schematic fashion how the pivoting components of the second working example pivot about the receiving portion.
Figure 9B:
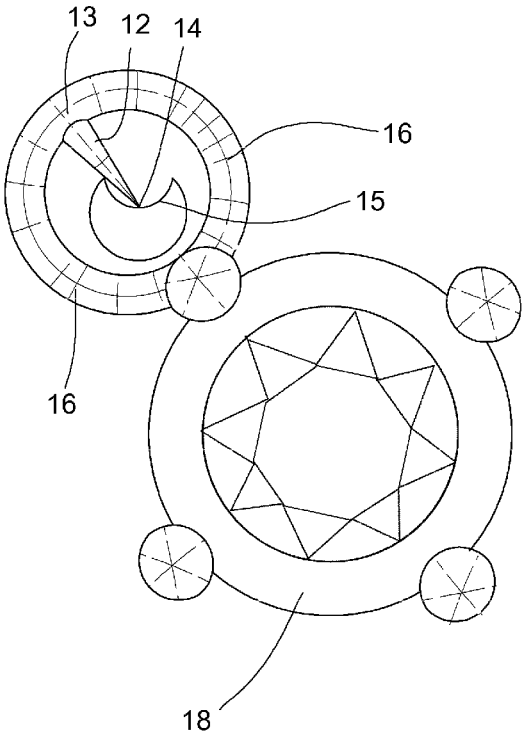

Furthermore, with respect to the pivot shaft (12), besides being those which are in the shape of a slender cylinder, those resembling a conical needle, the bottom end of which is the pointed side, such as are shown in FIG. 8, FIG. 9A, and FIG. 9B, and the like may be cited as examples. With regard to contact with the receiving portion (15), because point contact is desirable, it is preferred that the pivot shaft (12) be made in the shape of downward-pointing cone so as to cause the shape at the tip of the pivot shaft bottom end (14) (12) to be needle-like, or that the region toward the bottom end (14) thereof be curved in hemispherical fashion as shown in FIG. 3 and FIG. 4.

Now, because the jewelry member (17) that is suspended from the bottom end of the suspending arm portion (16) is such that the weight of the jewelry member (17) will vary greatly depending on the design employed thereat and depending on the size of the gemstone that is gripped thereby, the location of the overall center of gravity of the pivoting components will differ depending on the weight and size of the member that is suspended therefrom. The further that the center of gravity of the pivoting components is disposed below the height of the pivot point of the pivot shaft bottom end (14) the better, as this will generally facilitate pivoting. Adjustment of the length of the pivot shaft (12), the length of the suspending arm (16), the location of the suspended jewelry member (17), and so forth in light of the height of the pivot point of the pivot shaft bottom end (14) and the location of the center of gravity of the pivoting components will therefore permit stable pivoting to be attained. It should at least be the case that the center of gravity of the pivoting components, when at rest, is not higher than the height of the pivot point of the pivot shaft bottom end (14).

—Swinging—

Figures 5A, 5B, 5C:
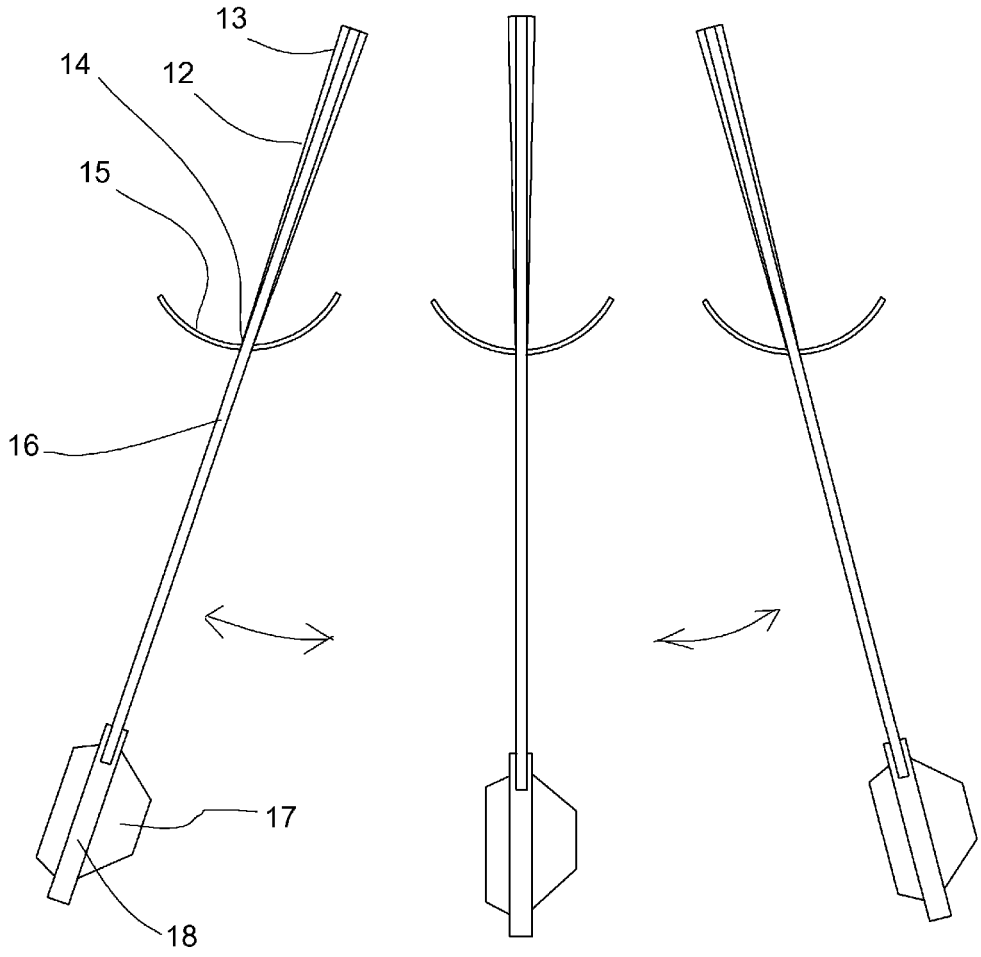
FIGS. 5A to 5C Drawings illustrating in schematic fashion the movement of pivoting components when the pivot shaft tilts in the front-to-back direction.
Figure 6:
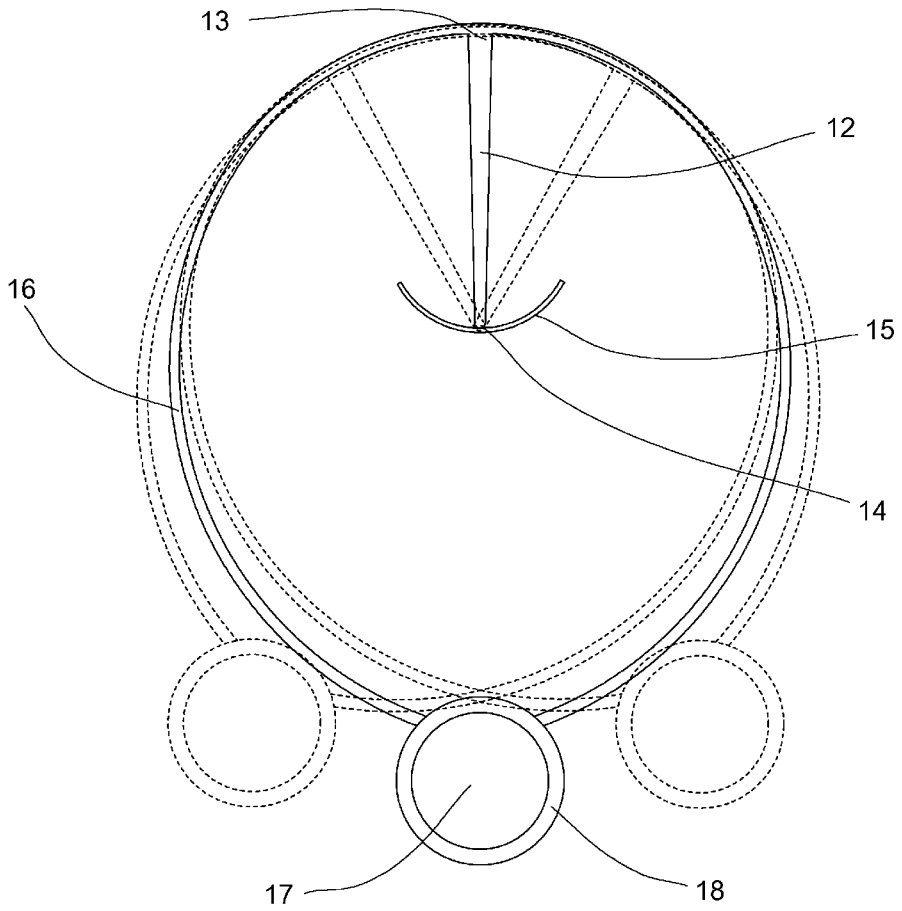
FIG. 6 Drawing illustrating in schematic fashion the movement of pivoting components when the pivot shaft tilts in the left-to-right direction.

Now, whereas pivot shaft (12), upon being tilted, attempts to return to a location at which it will ultimately come to be at rest as shown in FIG. 5B and in solid line at FIG. 6, as the only point of contact with receiving portion (15) is where it comes in contact therewith at the pivot point, it tends to be extremely sensitive and to easily engage in swinging. It therefore repeatedly pivots in continuous fashion, continuing in motion in quivering fashion until the swinging subsides. That is, once it has been set to swinging, because it repeatedly swings back and forth until it eventually reaches the point where it is stably at rest, it pivots continuously for a long time. This is because, for small angular inclinations, it pivots repeatedly after the fashion of the motion of a pendulum engaging in simple harmonic motion. It causes jewelry member (17) to pivot continuously for much longer than has been the case with conventional ornaments employing jewelry members that are capable of oscillation.

In addition, swinging on the order of the sort that is repeatedly engaged in by a wearer who is performing activity on the order of normal breathing, or who makes slight changes in posture, will be enough to impart new pivoting thereto. Swinging therefore never in practice completely subsides and comes to rest, minute pivoting being engaged in repeatedly so long as the ornament of the present invention is worn. This being the case, reflected light and refracted light produced by the cut of the gemstone flashes and flickers in minute patterns, producing multicolored fire, the beauty of which is easily noticed by peripheral onlookers. This is because the fire of a gemstone is such that the true value thereof is more easily made manifest by the sparkling that occurs as a result of its being made to swing and move about. In this way, the ornament of the present invention has high ornamental presentability.

Furthermore, because the jewelry member (17) suspended from the arm-like suspending portion (16) swings in correspondence to the direction in which swinging is applied thereto, the changing direction of the center of gravity swings and moves about front-and-back and left-and-right in manifold ways. Because when the center of gravity changes greatly in correspondence to the swinging the direction thereof also varies widely, the direction in which pivoting occurs is not limited to being simple left-to-right movement but is capable of engaging in extremely complex modes of swinging. Furthermore, because adequate variation can be obtained in the reflections from the jewelry member (17) with respect to the light incident thereon even when the inclination of the pivot shaft (12) relative to its orientation when at rest is limited to an angle as small as on the order of, e.g., 10 degrees, and because this causes generation of fire as it sparkles and glitters, it is capable of adequate generation of brilliance even over the range of inclinations permitting stable movement.

Now, because the weights of the ornament body (11) and the jewelry member and other pivoting components are such that there is large difference in mass therebetween, the pivoting components and the ornament body (11) itself have different swinging periods. When the ornament body (11) is heavy, the ornament body (11) will not swing, permitting a situation in which it is only the pivoting components that will continue to undergo minute swinging. Among such situations, there are many cases in which the ornament body (11) is worn in such fashion that it comes in contact with the body of the wearer. For example, in the case of a necklace, this is worn in such fashion that the pendant serving as ornament body (11) comes in contact with the chest. This being the case, the ornament body (11) will not engage in fine and minute oscillations but will remain still, as if fixed in place alongside the chest, and so the pivoting components, which swing about the pivot shaft bottom end (14) which serves as pivot point, will not be attenuated due to reaction to swinging of other components or the like but will be able to continue to undergo fine oscillations for a long time. Furthermore, unlike the low-frequency high-amplitude overall swinging of the ornament body (11) with its large mass, because the pivoting components with their small mass swing about the bottom end of the short pivot shaft which serves as pivot point, and because the distance between the pivot point and the center of gravity is shorter than the distance between the pivot point and the center of gravity applicable to swinging of the ornament body (11), the periods of oscillation of this swinging are such that that of the pivoting components is much smaller than that of the other. As compared with the swinging of the overall ornament body (11), because this therefore makes it possible to obtain myriad repetitions of the sparkling and glittering fire of the pivoting components, this greatly facilitates attainment of visual effectiveness. While period will vary depending on the mass of the pivoting components, it is possible to obtain minute swinging in which the period is on the order of 3 cycles per second. With diamonds and the like, it is usually the case that the larger and more spectacular the diamond the greater the tendency for its brilliance to be visually perceived; however, in accordance with this invention, because even a small-carat diamond is made to swing and move about in extremely minute fashion, the eye is easily drawn to that repeating pattern of sparkly glitter, increasing the value of the diamond and causing its fire-like characteristics to be brought forth in very magnificent fashion.

Figure 7:
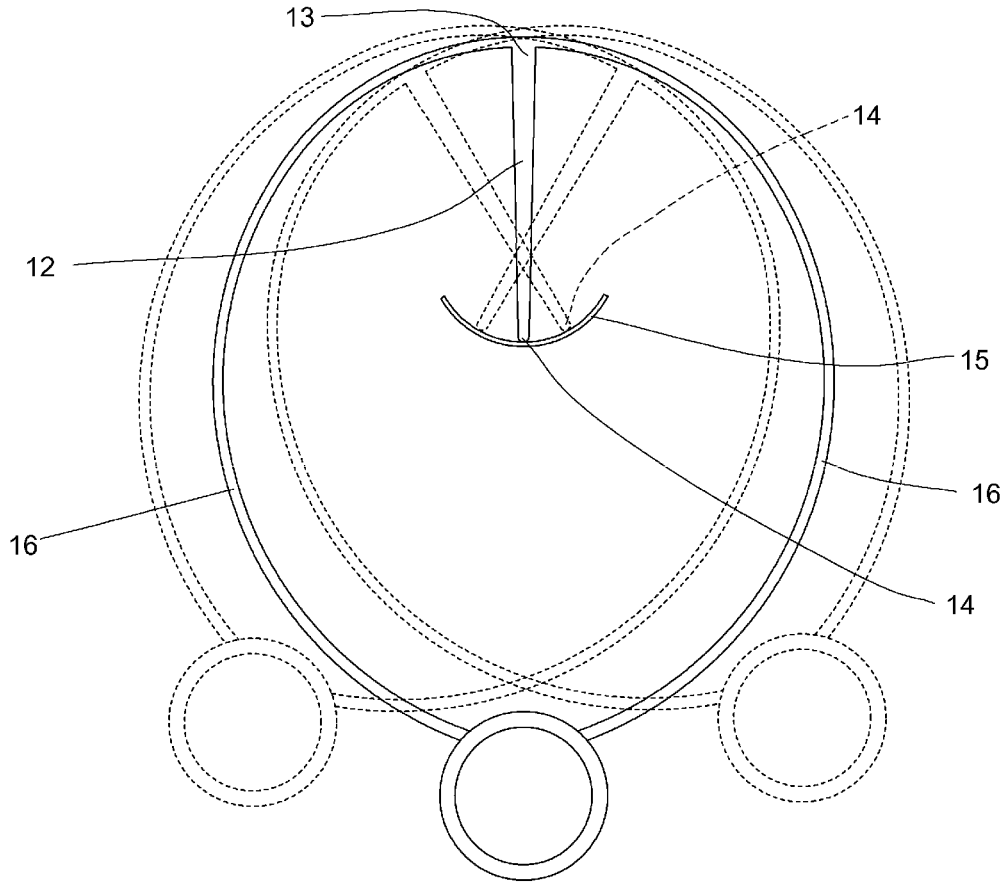
FIG. 7 Drawing illustrating in schematic fashion the movement of pivoting components and the movement of the bottom end of the pivot shaft when the pivot shaft swings and moves about by a large amount in the left-to-right direction due to the fact that a large oscillation has been imparted thereto.

Moreover, where a U-shaped groove (24) of a rail (25) curved in the shape of a half-moon is made to serve as receiving portion (15), and the pivot shaft bottom end (14) is made to come in contact with the lowest portion of the groove (24), when this is set to swinging in a direction which as viewed from above is not perpendicular to the rail but is such that the swinging makes an oblique angle with respect to the rail, movement such as would cause the pivot shaft bottom end to come in contact with the sloped surface within the U-shaped groove as shown in FIG. 7 causes the pivot shaft top end (13) to engage not in simple-harmonic-like motion but in a three-dimensional behavior similar to that which would occur if a figure-eight-like locus were being described. This being the case, because the suspended jewelry member not only swings front-and-back but is also made to swing and move about as its direction is twisted left-and-right, there is great production of variation in the sparkling reflections, and visual perceptibility of the variation is increased.

Described below is a working example in which 18-karat gold alloy was employed as precious metal at the pivoting components and the pendant of the ornament body (11) of the present invention, and a diamond was employed as the suspended jewelry member (17). Of course, other alloy(s), e.g., platinum 950, may be substituted as the precious metal, and the same holds true for gemstones other than diamond.

Working Example 1

The ornament shown in FIG. 1 is a necklace having a pendant. The ornament body (11) is a pendant having a weight of approximately 1.1 g and a height such that the outside diameter thereof is 11 mm, the top end of the frame thereof which is made of 18-karat gold alloy having an opening in the form of a bail (21) through which a necklace is inserted, insertion of a necklace (20) of identical color which is made of 18-karat gold alloy through said bail (21) permitting this to be worn on the body. At Working Example 1, ornament body (11) is itself such that it also is of substantial decorativeness as a pendant, its external appearance, as shown in FIG. 1, being such that it is of cage-like shape, being provided with a central cavity (22), being engraved in patterns of intricate artisanship, and being decorated with small-carat diamonds slightly smaller than 1 mm at three peripheral locations thereon. In addition, in the vicinity of the top end of the central cavity (22) of ornament body (11), as shown in enlarged fashion at FIG. 2 and FIG. 3, rail (25) which is as long as 5 mm and which is curved in the shape of a half-moon is arranged, a groove (24) being formed at the top face in the long direction of the rail, the entirety of this groove (24) serving as a receiving portion (15). A pivot shaft (12) of length 2 mm stands in freely pivotable fashion in, as the bottom end (14) thereof makes contact with, the groove (24) of the receiving portion (15), a suspending arm portion (16) which is curved so as to permit support from either side to left and right extending below the pivot shaft top end (13), straddling the rail (25) and reaching the upper portion of the space in the central cavity (22). Provided at the lower portion of the suspending arm portion (16) is a setting (18), the size of the setting be large in the present working example. Captured within the setting (18) in such fashion as to cause the table thereof to face to the side is a 0.1-carat round brilliant cut diamond which serves as jewelry member (17) and which is suspended below the suspending arm portion (16) as a result of being secured by prongs (19) at the setting (18).

As indicated by the arrow in FIG. 3, the pivot shaft (12) is capable of pivoting front-and-back and left-and-right without restriction. In addition, as shown in FIGS. 5A to 5C, relative to FIG. 5B which shows the situation when it is at rest, taking the table of the diamond at the jewelry member (17) as the front, the way this swings in the front-to-back direction is shown at FIGS. 5A and 5C. At this drawing, because the upper portion of the suspending arm portion (16) and the pivot shaft (12) are shown in overlapping fashion, the pivot shaft is hidden by the suspending arm portion (16) in the drawing. At the drawing, the pivot shaft bottom end (14) which serves as pivot point of the pivoting components is in contact with the bottom of the receiving portion (15) which is curved in cuplike fashion. FIG. 6 shows how the pivoting components swing and move about in the left-to-right direction about the pivot shaft bottom end (14) as pivot point when the pivot shaft (12) is tilted in the left-to-right direction.

It will of course be the case that movement of the pivot shaft bottom end (14) within the receiving portion (15) which is curved in cuplike fashion as indicated by the pivot shaft shown in FIG. 7 will be permitted. When swinging becomes vigorous, the pivot point is able to move along the slope of the receiving portion (15) as shown in FIG. 7, as a result of which it will be possible for pivoting to occur smoothly even when the tilt angle is large, and disengagement of the pivot shaft from the receiving portion can also be suppressed. As what is indicated at FIG. 7 is a mechanism for accommodating the situation that exists when motion is vigorous, tilting of the pivot shaft will be as indicated at FIGS. 5A to 5C and FIG. 6 when there is little momentum, at which time minute swinging will be carried out in repetitive fashion.

Note that the ornament in accordance with the present invention which is indicated at Working Example 1 is such that the pivoting components and the suspended jewelry member are not limited to reciprocating-motion-like oscillation which would be restricted to a single direction but are capable of pivoting in many directions front-and-back and left-and-right. In addition, when this is set to swinging in a direction which as viewed from above would cause an oblique angle to be made thereby with respect to the rail (25), this will permit the mode of swinging to be three-dimensional, with complex swinging and moving about such as would occur if a figure-eight-like locus were being described. Note also that even where there is variation in the intensity of the force that is applied thereto, and even where there is variation in the direction in which the force is applied thereto, because the amplitude is not really all that large, it will continue to pivot minutely in repetitive fashion about the pivot shaft bottom end as pivot point with a more or less constant period to the swinging. Note, further, that the center of gravity of the pivoting components at the working example is disposed at a location that is below the location of the pivot point of the pivot shaft bottom end (14).

Whereas Working Example 1 employs a diamond as the jewelry member (17), as the refractive index of diamond is high, being 2.42, the surface thereof may be polished to a mirror-like finish so as to permit utilization of total reflection. By therefore employing complex cuts such as a 58-facet brilliant cut, surface reflection of light incident from various directions on the cut diamond will permit this to sparkle and glitter in minute fashion. Here, refraction and reflection permit even more complex brilliance. At Working Example 1, because, as has been described above, above swinging continues for around 60 seconds, and because the wearer will apply an oscillation thereto as a result of performing some new motion during this period, in practice, when worn, it will continue to swing in uninterrupted fashion.

Now, with respect to how the ornament of Working Example 1 shown in FIG. 1 continues to swing, the pendant was placed in an upright stand and this was placed on a table, and the time until swinging subsided following application of one oscillation was measured. Because the diamond produced a fire-like display, the time when the sparkling reflections from the swinging subsided was determined to be the time at which oscillation stopped. The upright stand had an upright support that was 80 degrees, the pendant being retained in such fashion as to come in contact with and rest against the surface of the upright support so as to cause the pendant to come in contact with the chest of the body. This being the case, the pendant, which is to say the ornament body, was almost completely free from swinging, as the diamond of the pivoting components continued to pivot with a tiny period.

In addition, when the foregoing pendant was placed on the stand, and an oscillation was applied to the table one time, with the item of the present invention, the pivoting components engaged in swinging and the diamond of the jewelry member repeatedly glittered in sparkling fashion, approximately 60 seconds being required before the glittering of the diamond subsided. Oscillations were applied from a variety of directions, but in all cases swinging continued for not less than 45 seconds, the average being around 60 seconds.

By way of comparison, a product having a structure as described at Patent Reference No. 3 was similarly placed atop a table and oscillations were applied thereto. Upon so doing, while it did oscillate in minute fashion, that swinging had subsided within on the order of 10 to 20 seconds. Furthermore, because it was restricted with respect to the direction in which it tended to swing, large variation in swinging occurred depending on the direction in which the oscillations were applied.

Furthermore, with other conventional ornaments, the jewelry member of the ornament was capable of freely oscillating in the left-to-right direction; however, with respect to the front-to-back direction, while it did oscillate relatively freely when a small force was applied thereto, when a large force was applied thereto the jewelry member did not oscillate either toward the front or the back but moved in a manner akin to sliding and/or it could be determined that it did not continue to oscillate. For this reason, while luster, brilliance, and fire were temporarily produced by the jewelry member, the swinging subsided relatively quickly.

Working Example 2

As the mode of another working example which is shown in FIG. 8, a constitution is shown in which a concave depression provided at the top central surface of a horizontal rod (23) provided at the upper portion of a cavity (22) in the ornament is made to serve as a receiving portion (15), a conical pivot shaft (12), the tip of which is the bottom end (14), being made to contact the receiving portion (15) at this location. Furthermore, FIGS. 9A and 9B show how the pivot shaft bottom end (14) makes contact with the receiving portion (15), and how as it does so it acts as pivot point about which the pivoting components pivot. FIG. 9A shows the situation when at rest, and FIG. 9B shows the situation when the pivot shaft is tilted to the left. At FIG. 9B, jewelry member (17) moves to the side opposite pivot shaft top end (13). In other words, at FIG. 9B, unlike FIG. 9A, when the height of the jewelry member (17) has moved to a location that is somewhat high, and pivot shaft top end (13) is inclined to the left, the center of gravity conversely moves slightly diagonally upward and to the right. From this point, pivot shaft (12) does not proceed to fall down but moves so as to swing back about pivot shaft bottom end (14) as pivot point, as a result of which it is able to swing in repeating fashion.

EXPLANATION OF REFERENCE NUMERALS

11 Ornament body
12 Pivot shaft
13 Pivot shaft top end portion
14 Pivot shaft bottom end
15 Receiving portion
16 Suspending arm portion
17 Jewelry member
18 Setting
19 Prongs
20 Necklace
21 Bail
22 Cavity
23 Horizontal rod
24 Groove
25 Rail

The invention claimed is:

1. An ornament comprising:

an ornament body which is provided with a receiving portion;

a pivot shaft provided in erect fashion, and engaging the receiving portion in such manner that only a bottom end portion of the pivot shaft makes contact with said receiving portion;

a rigid suspending arm portion that protrudes from a top end portion of said pivot shaft; and a jewelry member supported by a lower portion of said suspending arm portion;

wherein said pivot shaft, said suspending arm portion, and the jewelry member supported in pendant fashion by the lower portion of said suspending arm portion are formed in integral fashion; and said pivot shaft is capable of swinging about a contact point of said receiving portion.

2. The ornament according to claim 1, wherein the suspending arm portion is an arcuate or ring-like rigid body; and the jewelry member supported in pendant fashion by the lower portion of said suspending arm portion hangs below the receiving portion.

3. The ornament according to claim 2, wherein the receiving portion is provided along a long direction thereof with a groove, a top face of which is open; and the long direction thereof is curved in arcuate half-moon fashion.

4. The ornament according to claim 2, wherein the receiving portion is a rail having a U-shaped cross-section, a top face of which is an open end thereof; and said rail is curved in arcuate half-moon fashion in a long direction thereof.

5. The ornament according to claim 2, wherein the receiving portion is depressed in concave fashion at a center thereof.

6. The ornament according to claim 2, wherein the bottom end of the pivot shaft is curved in hemispheric fashion.

7. The ornament according to claim 2, wherein the bottom end of the pivot shaft is in a shape of a conically pointed needle.

8. The ornament according to claim 1, wherein the receiving portion is provided along a longitudinal direction thereof with a groove, a top face of which is open; and the long direction thereof is curved in arcuate half-moon fashion.

9. The ornament according to claim 8, wherein the bottom end of the pivot shaft is curved in hemispheric fashion.

10. The ornament according to claim 8, wherein the bottom end of the pivot shaft is in a shape of a conically pointed needle.

11. The ornament according to claim 1, wherein the receiving portion is a rail having a U-shaped cross-section, a top face of which is an open end thereof; and said rail is curved in arcuate half-moon fashion in a long direction thereof.

12. The ornament according to claim 11, wherein the bottom end of the pivot shaft is curved in hemispheric fashion.

13. The ornament according to claim 11, wherein the bottom end of the pivot shaft is in a shape of a conically pointed needle.

14. The ornament according to claim 1, wherein the receiving portion is depressed in concave fashion at a center thereof.

15. The ornament according to claim 14, wherein the bottom end of the pivot shaft is curved in hemispheric fashion.

16. The ornament according to claim 14, wherein the bottom end of the pivot shaft is in a shape of a conically pointed needle.

17. The ornament according to claim 1, wherein the bottom end of the pivot shaft is curved in hemispheric fashion.

18. The ornament according to claim 1, wherein the bottom end of the pivot shaft is in a shape of a conically pointed needle.

* * * * *